US009205670B1

(12) United States Patent
Ganesan et al.

(10) Patent No.: US 9,205,670 B1
(45) Date of Patent: Dec. 8, 2015

(54) PRINTHEAD INCLUDING AN ASSEMBLY FOR CLEANING A LENS AND A DISPLACEABLE LIGHT-EMITTING DIODE ASSEMBLY AND METHODS THEREOF

(71) Applicant: Xerox Corporation, Norwalk, CT (US)

(72) Inventors: Vinoth Kumar Ganesan, Tamil Nadu (IN); Aravindan Ekambaram, Chennai (IN); Kumaran Vairavan, Tamil Nadu (IN); Richard David Emms, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/571,849

(22) Filed: Dec. 16, 2014

(51) Int. Cl.
*B41J 2/385* (2006.01)
*G03G 13/04* (2006.01)
*B41J 2/45* (2006.01)

(52) U.S. Cl.
CPC ..... *B41J 2/45* (2013.01)

(58) Field of Classification Search
CPC ..... B41J 2/16508; B41J 2/16511; B41J 2/16523; B41J 2/16535; B41J 2/16538; B41J 2/16541; B41J 2/16547; B41J 2/16585; B41J 2/1714; B41J 2/185; B41J 2/20; B41J 2002/7142
USPC ..... 347/32–34, 102, 130
See application file for complete search history.

(56) References Cited

U.S. PATENT DOCUMENTS

2007/0019057 A1* 1/2007 Kondo et al. ..... 347/130
2013/0088558 A1* 4/2013 Nakajima ..... 347/224

* cited by examiner

*Primary Examiner* — Manish S Shah
*Assistant Examiner* — Roger W Pisha, II
(74) *Attorney, Agent, or Firm* — Simpson & Simpson, PLLC

(57) ABSTRACT

A printhead for a device capable of printing, including: a frame; a light-emitting diode (LED) assembly including a housing engaged with the frame, a plurality of LEDs on the housing and extending in a first transverse direction, and at least one lens parallel to the plurality of LEDs in the first traverse direction and arranged to focus light from the LEDs; and a lens cleaning assembly engaged with the frame and including an arm portion extending across the frame in the first traverse direction and a cleaner portion including a cleaning element. The lens cleaning assembly is displaceable, with respect to the frame, in the first transverse direction to slide the cleaning element across the at least one lens.

10 Claims, 7 Drawing Sheets

PRINTHEAD INCLUDING AN ASSEMBLY FOR CLEANING A LENS AND A DISPLACEABLE LIGHT-EMITTING DIODE ASSEMBLY AND METHODS THEREOF

TECHNICAL FIELD

The present disclosure relates to an assembly for cleaning a lens for light-emitting diodes (LEDs) for a printbar and to a displaceable assembly for a printbar including LEDs for the printbar and methods thereof.

BACKGROUND

For a printbar including light-emitting diodes (LEDs), dust and debris can coat and obscure a lens used to focus light from the LEDs during operation of the printhead. In particular, during operation of the printhead, media passing through the printhead can generate particulate which coats the lens. Coating the lens undesirably decreases the intensity of the light from the LEDs, adversely affecting printing quality. Known methods of cleaning a lens for an LED printbar entail removal of components to reach and clean the lens, which can be time intensive and may require expertise not available to most users of a device including the printbar.

SUMMARY

According to aspects illustrated herein, there is provided a printhead for a device capable of printing, including: a frame; a light-emitting diode (LED) assembly including a housing engaged with the frame, a plurality of LEDs on the housing and extending in a first transverse direction, and at least one lens parallel to the plurality of LEDs in the first traverse direction and arranged to focus light from the LEDs; and a lens cleaning assembly engaged with the frame and including an arm portion extending across the frame in the first traverse direction and a cleaner portion including a cleaning element. The lens cleaning assembly is displaceable, with respect to the frame, in the first transverse direction to slide the cleaning element across the at least one lens.

According to aspects illustrated herein, there is provided a printhead for a device capable of printing, including: a frame; a light-emitting diode (LED) assembly including a housing engaged with the frame, a plurality of LEDs one the housing and extending in a first transverse direction, and at least one lens parallel to the plurality of LEDs in the first traverse direction and arranged to focus light from the LEDs; and a displacement assembly connected to the frame and engaged with the LED assembly and arranged to displace the LED assembly, with respect to the frame to a first position for an operating mode for the printhead, in which light from the plurality of LEDs illuminates media passing through the printbar in first or second process directions orthogonal to the first transverse direction and to a second position for a cleaning mode for the printhead, in which a cleaning operation for the at least one lens is enabled.

According to aspects illustrated herein, there is provided a lens cleaning assembly, including: an arm portion arranged to engage with a frame for a printhead and extending in a first traverse direction; and a cleaner portion arranged to engage with the frame and a housing for a light-emitting diode (LED) assembly for the printhead, the LED assembly including a plurality of LEDs and at least one lens for focusing light from the plurality of LEDs, and including a cleaning element, wherein the lens cleaning assembly is arranged to displace in the first transverse direction, with respect to the frame, to slide the cleaning element across the at least one lens for the LED assembly.

According to aspects illustrated herein, there is provided a method of cleaning a lens for printhead for a device capable of printing, the print head including: a frame; a light-emitting diode (LED) assembly including a housing engaged with the frame, a plurality of LEDs, and at least one lens arranged to focus light from the LED, the method including: engaging a lens cleaning assembly with the frame; and for a cleaning mode for the printhead: displacing the lens cleaning assembly in the first transverse direction with respect to the frame; contacting the at least one lens with a cleaning element for the lens cleaning assembly; and sliding the lens cleaning element across the at least one lens.

According to aspects illustrated herein, there is provided a method of operating a printhead for a device capable of printing, the printhead including: a frame; a light-emitting diode (LED) assembly including a housing engaged with the frame, a plurality of LEDs, and at least one lens arranged to focus light from the LED, the method including: for an operating mode for the printhead, displacing, using a displacement assembly connected to the frame and engaged with the LED assembly, the LED assembly in a first direction and, illuminating media, passing through the printbar in a first or second process direction orthogonal to the first direction, with light focused by the at least one lens; and, for a cleaning mode for the printhead, displacing, using the displacement assembly, the LED assembly in a second direction opposite the first direction.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Regarding the term "device useful for digital printing", it should be understood that digital printing broadly encompasses creating a printed output using a processor, software, and digital-based image files. It should be further understood that xerography, for example using light-emitting diodes (LEDs), is a form of digital printing.

Furthermore, as used herein, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, a server, one or more personal computers, a standalone scanner, a mobile phone, an MP3 player, audio electronics, video electronics, GPS systems, televisions, recording and/or reproducing media or any other type of consumer or non-consumer analog and/or digital electronics.

Moreover, although any methods, devices or materials similar or equivalent to those described herein can be used in the practice or testing of these embodiments, some embodiments of methods, devices, and materials are now described.

Figure 1:
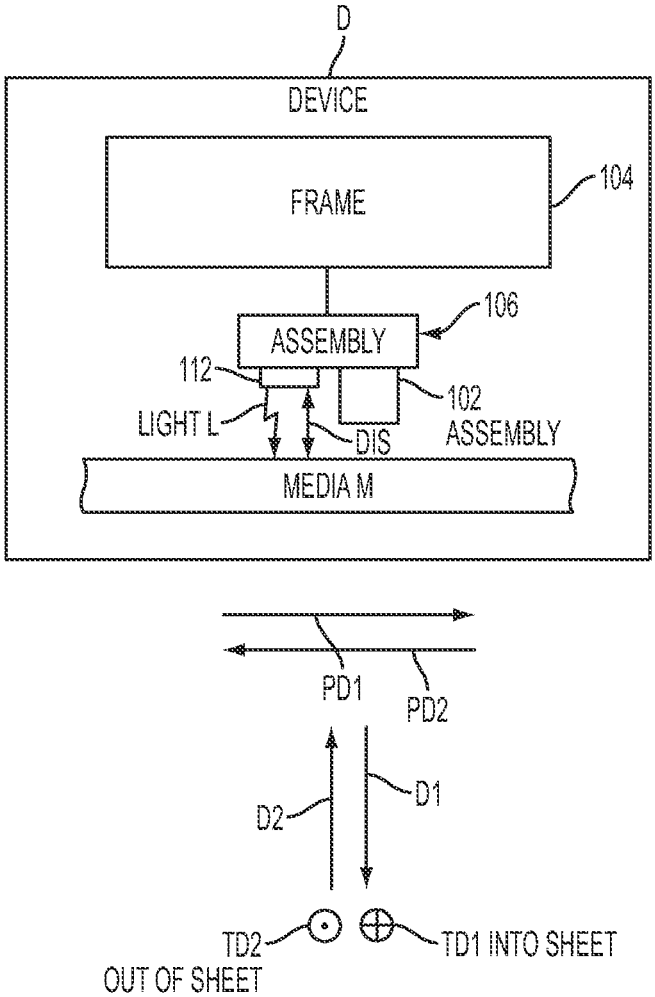
FIG. 1 is a schematic block diagram of a device capable of printing and including a printhead with a cleaning assembly.

FIG. 1 is a schematic block diagram of device D capable of printing and including printhead 100 with cleaning assembly 102.

Figure 2:
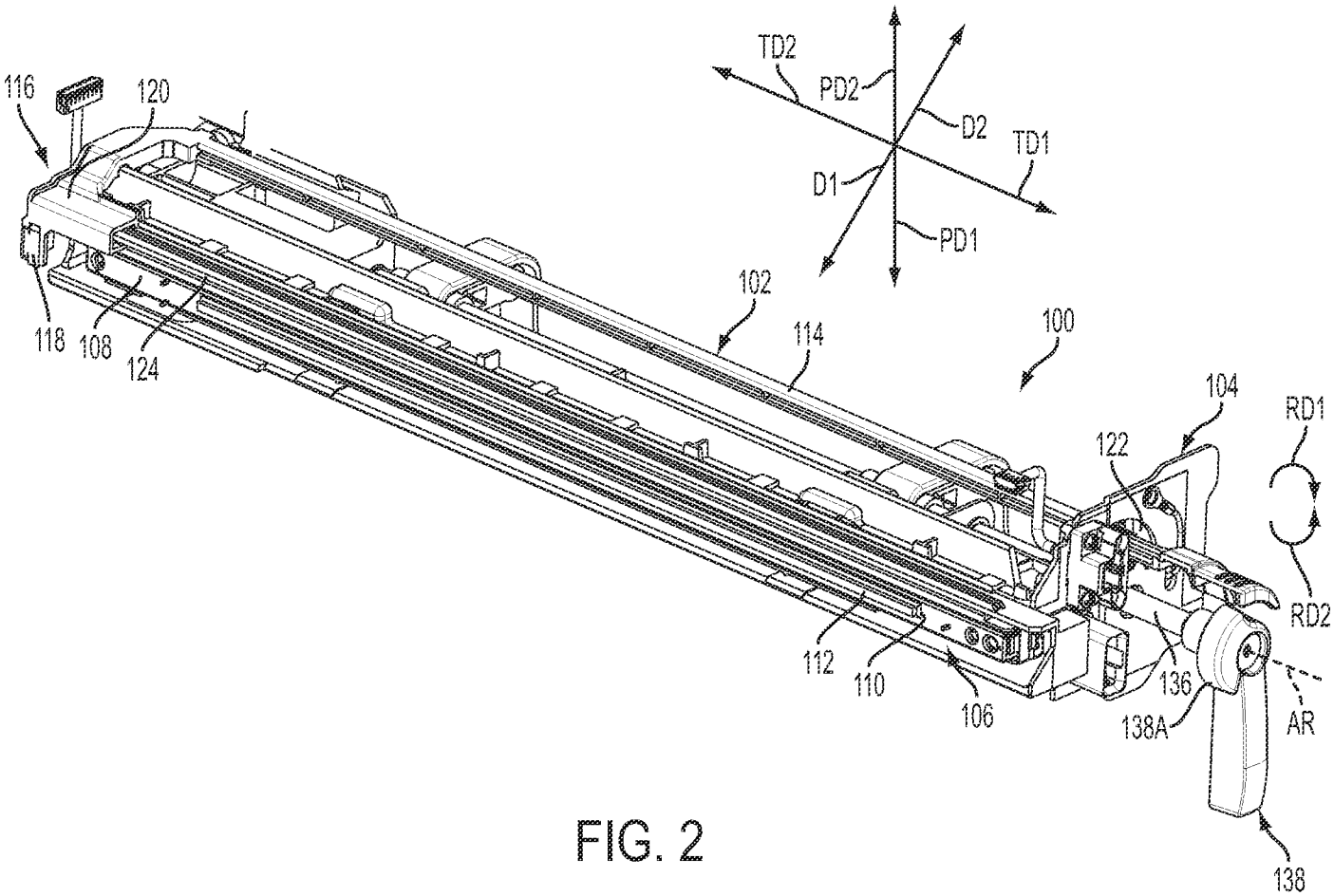
FIG. 2 is a perspective view of a printhead, with a lens cleaning assembly, in a cleaning mode.

FIG. 2 is a perspective view of printhead 100, with lens cleaning assembly 102, in a cleaning mode.

Figure 3:
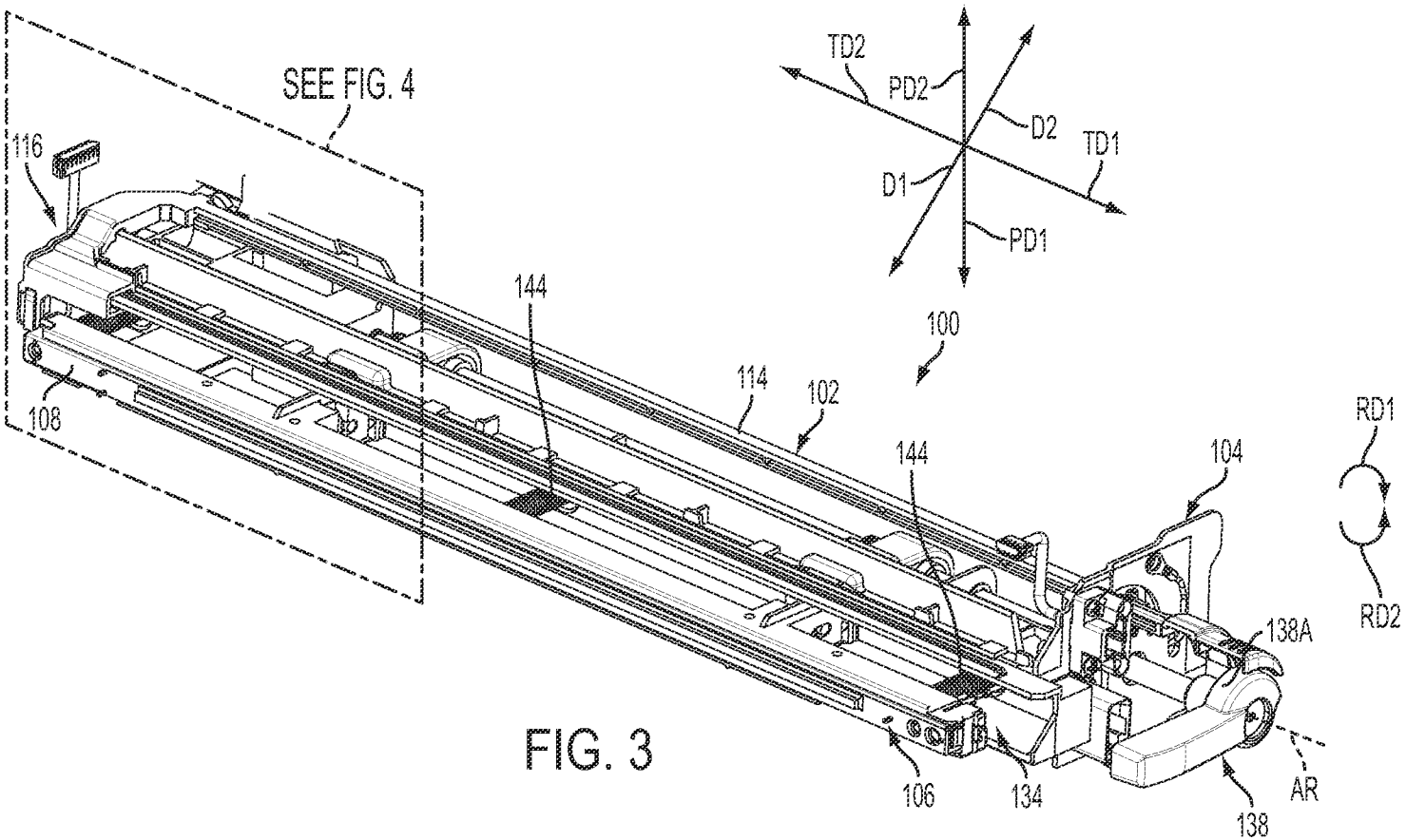
FIG. 3 is a perspective view of the printhead in FIG. 2, with the lens cleaning assembly, in an operating mode.

FIG. 3 is a perspective view of printhead 100 in FIG. 2, with lens cleaning assembly 102, in an operating mode.

Figure 4:
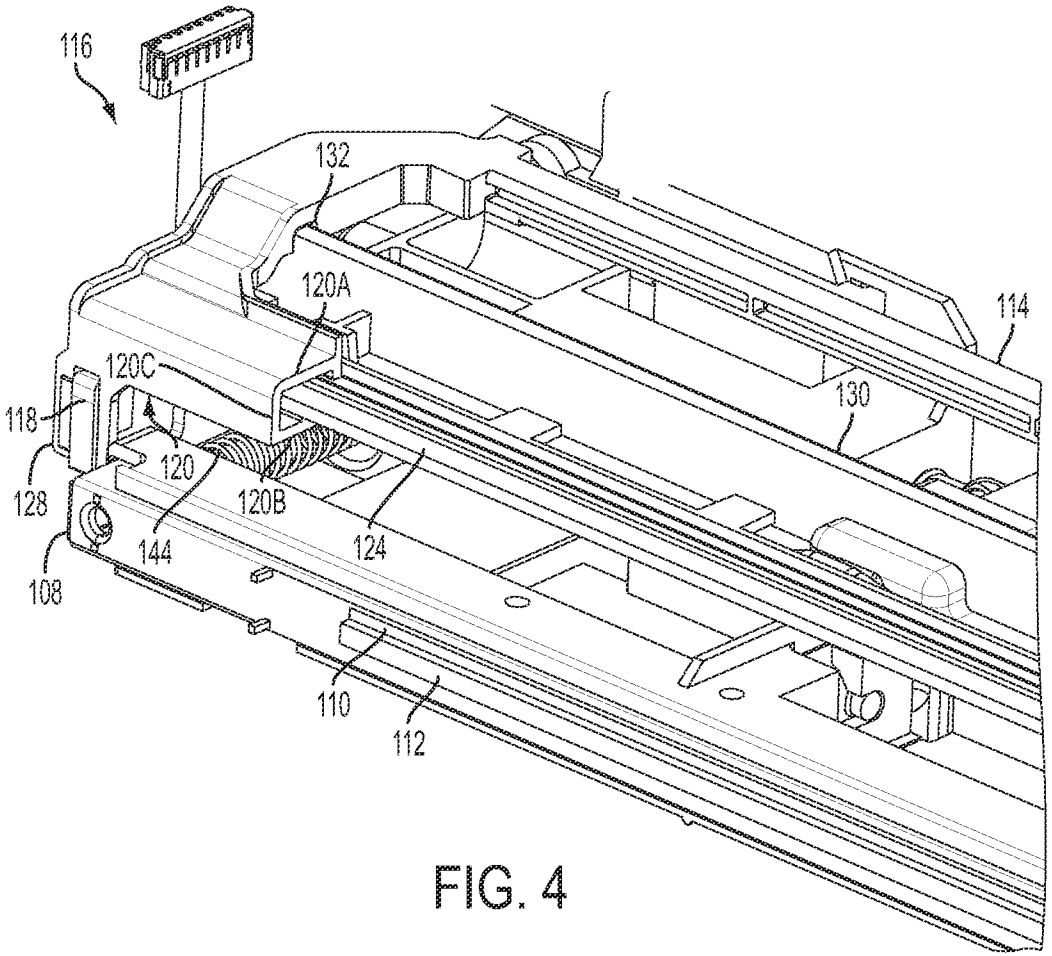
FIG. 4 is a detail of area 4 of FIG. 3.

FIG. 4 is a detail of area 4 of FIG. 3.

Figure 5:
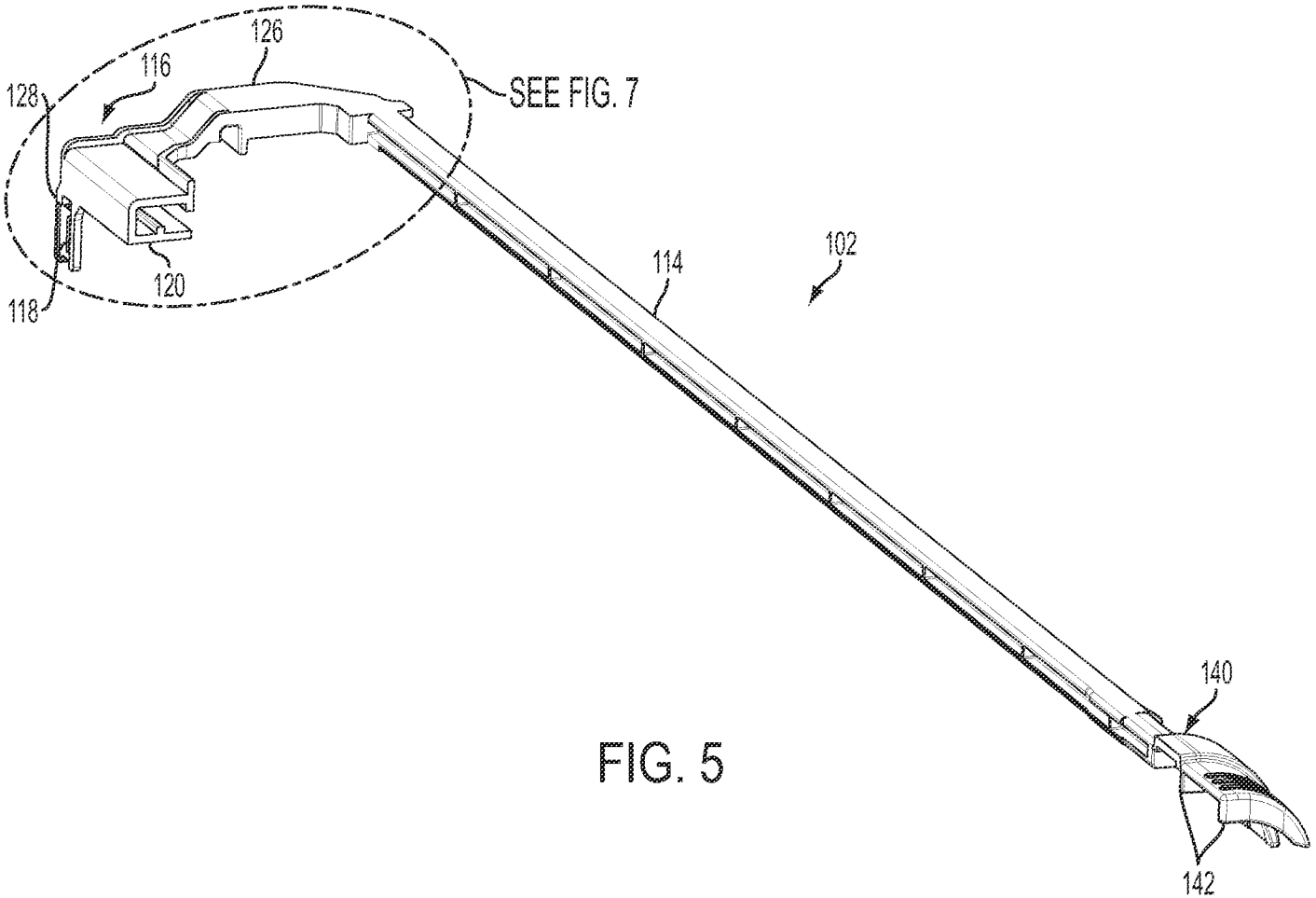
FIG. 5 is a perspective view of the lens cleaning assembly shown in FIG. 2.
Figure 6:
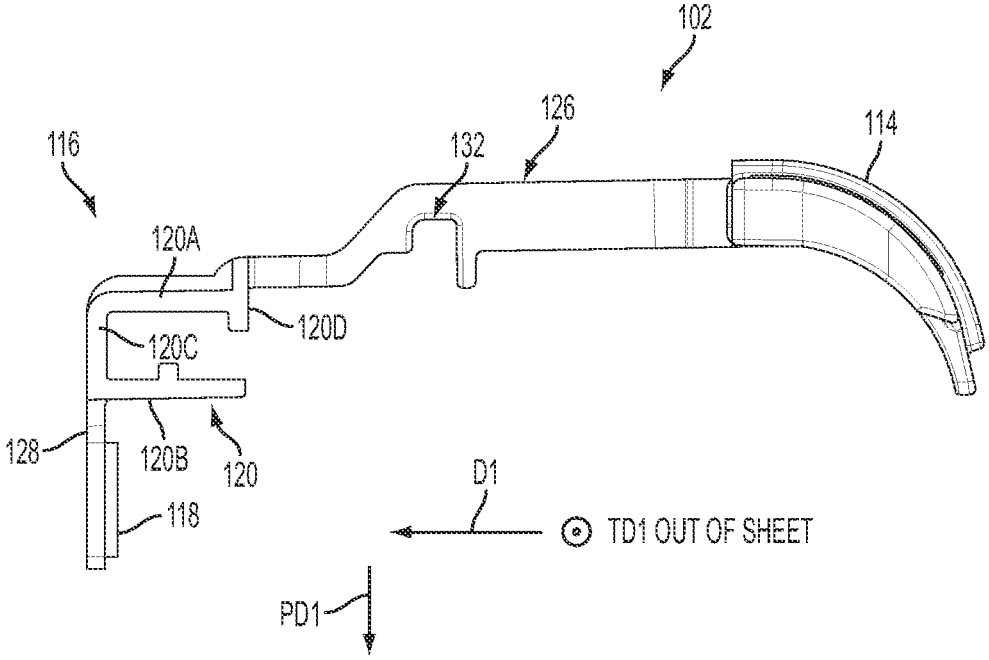
FIG. 6 is an end view of the lens cleaning assembly shown in FIG. 3.

FIG. 5 is a perspective view of lens cleaning assembly 102 shown in FIG. 2. The following should be viewed in light of FIGS. 1 through 5. Printhead 100 includes frame 104 and light-emitting diode (LED) assembly 106. Assembly 106 includes: housing 108 engaged with frame 104; LEDs 110 on housing 108 and extending in transverse direction TD1; and at least one lens 112 (hereinafter referred to as "lens 112") arranged to focus light from the LEDs. Assembly 102 includes: arm portion 114 engaged with the frame and extending across the frame in direction TD1; and cleaner portion 116 engaged with the frame, and including cleaning element 118. Assembly 102 is displaceable, with respect to frame 104, in directions TD1 and TD2 to slide cleaning element 118 across lens 112 to clean lens 112.

In an operating mode for the printhead, for example as shown in FIG. 3, lens cleaning assembly 102 is displaced in direction TD2 so that cleaning element 118 is not aligned with housing 108 in directions D1 or D2, for example, at least a portion of assembly 106 is beyond element 118 in direction D1. In the operating mode, light L focused by lens 112 illuminates media M passing through the printhead in process direction PD1 or PD2.

In a cleaning mode for the printhead, lens cleaning assembly 102 is displaceable in direction TD1 (from the position for the operating mode) to contact an entirety of lens 112 with cleaning element 118. In the cleaning mode, lens cleaning assembly 102 is displaceable in directions TD1 and TD2 to clean lens 112.

In an example embodiment, cleaner portion 116 includes substantially "U" shaped portion 120 and frame 104 includes slot 122 and rail 124 extending in direction TD1 and partially disposed within substantially "U" shaped portion 120. The arm portion is arranged to slide through slot 122 in directions TD1 and TD2, and portion 120 is arranged to slide along rail 124 in directions TD1 and TD2, for example during the cleaning mode. The engagement of portion 120 and rail 124 blocks movement of portion 120 in at least three directions orthogonal to direction TD1, for example, in directions PD1, PD2, and D2, due to contact of portions 120A, 120B, and 120C, respectively with rail 124. In an example embodiment, the engagement of portion 120 and rail 124 blocks movement of portion 120 in any directions except TD1 and TD2, for example, portion 120D blocks movement in direction D1 as well.

Figure 7:
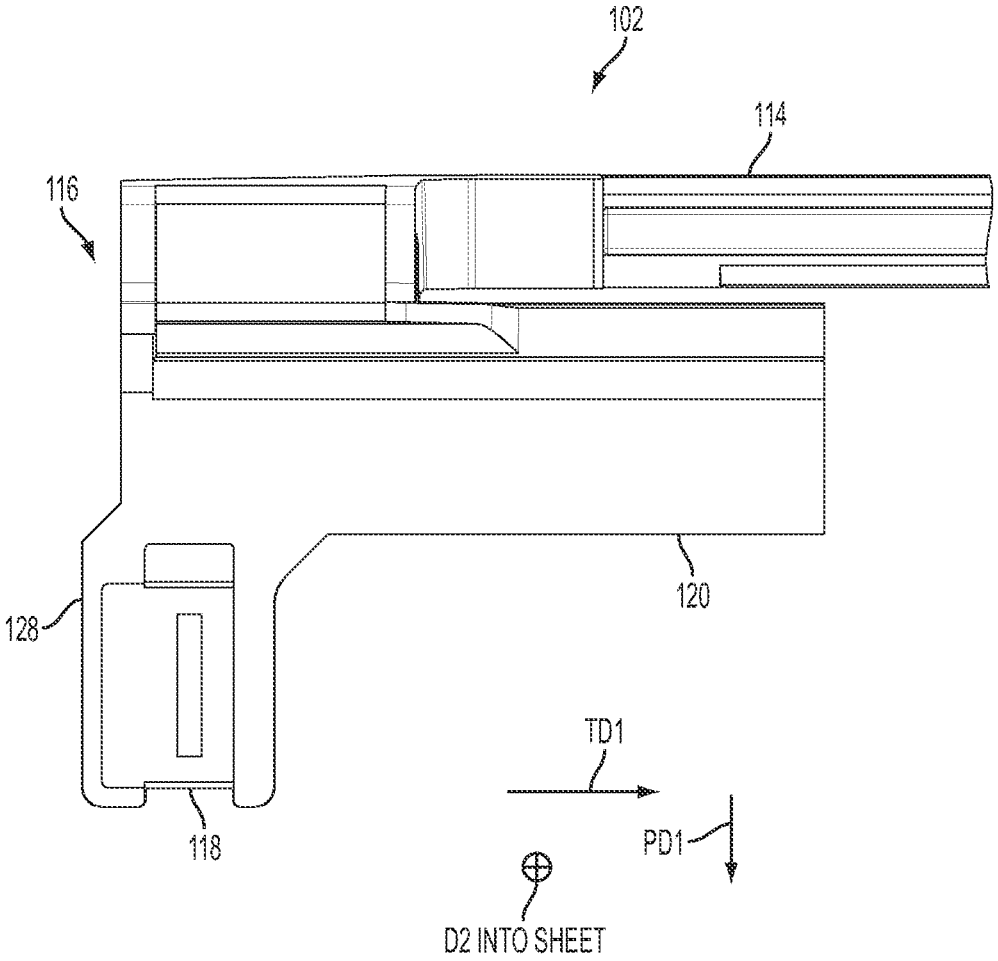
FIG. 7 is a front view of area 7 in FIG. 5.

FIG. 7 is a front view of area 7 in FIG. 5. The following should be viewed in light of FIGS. 1 through 7. Lens cleaning assembly 102 includes bridge portion 126 connecting portions 114 and 116 and extending from the arm portion to the cleaning portion in a direction D1. Portion 120 extends from bridge portion 126 in direction TD1. Portion 116 includes holder portion 128 extending from portion 120 in a process direction PD1. Element 118 is removeably connected to portion 128 (to enable replacement of element 118) and extends from portion 128 in direction D2 to engage lens 112 during the cleaning mode.

In an example embodiment, frame 104 includes rail 130 and portion 114 includes slot 132. Rail 130 and slot 132 extend in direction TD1. Slot 132 opens in direction PD1 and partially encloses rail 130. The engagement of rail 130 and slot 132 blocks movement of portion 114 in directions D1, D2, and PD1.

Printhead 100 includes displacement assembly 134 connected to frame 104 and engaged with assembly 106, in particular, housing 108. For the operating mode, displacement assembly 134 is arranged to displace LED assembly 106, with respect to frame 104, so that light L illuminates media M passing through printbar 100 in directions PD1 or PD2. For the cleaning mode, displacement assembly 134 is arranged to displace LED assembly 106, with respect to frame 104, so that assembly 102 is displaceable in direction TD1.

In an example embodiment, assembly 134 includes shaft 136 with an axis of rotation AR parallel to direction TD1. Shaft 136 is rotatable in rotational direction RD1 to displace the LED assembly in direction D1 to shift the printhead from the cleaning mode to the operating mode. Shaft 136 is rotatable in rotational direction RD2, opposite direction RD1, to displace the LED assembly in direction D2, to shift the printhead from the operating mode to the cleaning mode.

In an example embodiment, assembly 134 includes a blocking element blocking displacement of lens cleaning assembly 102 in direction TD1 while printhead 100 is in the operating position. For example, handle 138 for assembly 134 includes portion 138A that engages with handle 140 for assembly 102 (used by a user to displace assembly 102 in directions TD1 and TD2) as shown in FIG. 3. The engagement of portion 138A and lips 142 of handle 140 prevents movement of assembly 102 in direction TD1.

In an example embodiment, assembly 134 includes springs 144 urging LED assembly 106 in direction D1.

In an example embodiment, printhead 100 includes assembly 102, but not assembly 134. That is, assembly 106 is not displaceable. In an example embodiment, printhead 100 includes assembly 134, but not assembly 106. That is, assembly 106 is displaceable.

The following should be viewed in light of FIGS. 1 through 7. The following describes a method of cleaning a lens for printhead for a device capable of printing. Although the method is presented as a sequence of steps for clarity, no order should be inferred from the sequence unless explicitly stated. The print head includes: a frame; a light-emitting diode (LED) assembly including a housing engaged with the frame, a plurality of LEDs, and at least one lens arranged to focus light from the LED. A first step engages a lens cleaning assembly with the frame. For a cleaning mode for the printhead: a second step displaces the lens cleaning assembly in the first transverse direction with respect to the frame; a third step contacts the at least one lens with a cleaning element for the lens cleaning assembly; and a fourth step slides the lens cleaning element across the at least one lens.

In an example embodiment, engaging the lens cleaning assembly with the frame includes: engaging an arm portion of the lens cleaning assembly with a first portion of the frame so that the arm portion extends across the frame in the first traverse direction; and engaging a cleaner portion of the lens cleaning assembly, including the cleaning element, with a second portion of the frame. In an example embodiment, engaging an arm portion of the lens cleaning assembly with a first portion of the frame includes: positioning the arm portion in a first slot in the frame; and positioning a second slot in the arm portion, extending in the first transverse direction partially about a first rail for the frame. In an example embodiment, engaging a cleaner portion of the lens cleaning assembly with a second portion of the frame includes positioning a substantially "U" shaped portion for the cleaner portion about a second rail for the frame. In an example embodiment, displacing the lens cleaning assembly in the first transverse direction with respect to the frame includes sliding the arm portion through the first slot, sliding the arm portion along the first rail, and sliding the substantially "U" shaped portion along the second rail.

In an example embodiment, a fifth step blocks, with the first rail, movement of the arm portion in at least three directions orthogonal to the first transverse direction, and a sixth step blocks, with the second rail, movement of the substantially "U" shaped portion in any directions except the first and second transverse directions.

In an example embodiment, for an operating mode the printhead: a seventh step displaces, using a displacement assembly connected to the frame and engaged with the LED assembly, the LED assembly in a first direction, and an eighth step illuminates media, passing through the printbar in a first or second process direction orthogonal to the first direction, with light focused by the at least one lens; and for the cleaning mode of the printhead, a ninth step displaces, using the displacement assembly, the LED assembly in a second direction opposite the first direction.

The following should be viewed in light of FIGS. 1 through 7. The following describes a method of operating a printhead for a device capable of printing. Although the method is presented as a sequence of steps for clarity, no order should be inferred from the sequence unless explicitly stated. The printhead includes: a frame; a light-emitting diode (LED) assembly including a housing engaged with the frame, a plurality of LEDs, and at least one lens arranged to focus light from the LED. For an operating mode for the printhead: a first step displaces, using a displacement assembly connected to the frame and engaged with the LED assembly, the LED assembly in a first direction, and a second step illuminates media, passing through the printbar in a first or second process direction orthogonal to the first direction, with light focused by the at least one lens. For a cleaning mode for the printhead, a third step displaces, using the displacement assembly, the LED assembly in a second direction opposite the first direction.

In an example embodiment, a fourth step rotates a shaft for the displacement assembly in a first rotational direction to displace the LED assembly in the first direction, and a fifth step rotates the shaft in a second rotational direction, opposite first rotational direction, to displace the LED assembly in the second direction. In an example embodiment, a sixth step urges the LED assembly in the first direction with at least one spring.

In an example embodiment, for the cleaning mode: a seventh step engages a lens cleaning assembly with the frame; an eighth step displaces, with respect to the frame, the lens cleaning assembly in a first transverse direction orthogonal to the first process direction and the first direction; a ninth step contacts the at least one lens with a cleaning element for the lens cleaning assembly; and a tenth step slides the lens cleaning element across the at least one lens.

Advantageously, assembly 102 and methods using assembly 102 solve the problem noted above regarding coating of lens 112 without the requirement for component removal or technical expertise. To clean lens 112, the user merely rotates handle 138 to the position shown in FIG. 2, grasps handle 140 for assembly 102 and pulls/pushes handle 140 in directions TD1/TD2 as needed. When the cleaning is done, the user pushes handle all the way in direction TD2 and rotates the handle to the position shown in FIG. 3 to enable operation of the printhead. Further, the interlocking of portion 138A of handle 138 and lips 142 of handle 140 in the operating mode shown in FIG. 3 prevents accidently or unintentional displacement of element 118 across lens 112 during operation of the printhead.

Displacement assembly 134 enables clearances in printhead 100 for operation of assembly 102, while ensuring optimal light intensity on media M. For example, it is desirable to minimize distance DIS, shown in FIG. 1, to enable maximum light intensity on media M to ensure optimal results for the printhead. However, an optimal distance DIS during operation of printhead 100 may not provide adequate clearance for operation of assembly 102. Advantageously however; by displacing assembly 106 in direction D2 for the cleaning mode, distance DIS is increased to enable the clearance required for displacing element 118 across lens 112. Further, when operation of printhead 100 is required, assembly 102 is displaced in direction TD2 and assembly 106 is displaced in direction D1 to a desired value for DIS.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A printhead for a device capable of printing, comprising:
a frame;
a light-emitting diode (LED) assembly including:
a housing engaged with the frame;
a plurality of LEDs on the housing and extending in a first transverse direction; and,
at least one lens:
parallel to the plurality of LEDs in the first transverse direction; and,
arranged to focus light from the LEDs; and,
a lens cleaning assembly engaged with the frame and including:
an arm portion extending across the frame in the first transverse direction; and,
a cleaner portion including a cleaning element, wherein:
the lens cleaning assembly is displaceable, with respect to the frame, in the first transverse direction to slide the cleaning element across the at least one lens;
the cleaner portion includes a substantially "U" shaped portion;
the frame includes:
a slot; and,
a rail extending in the first transverse direction and partially disposed within the substantially "U" shaped portion;
the arm portion is arranged to slide through the slot;

the substantially "U" shaped portion is arranged to slide along the rail;

the lens cleaning assembly includes a bridge portion connecting the arm and cleaning portions and extending from the arm portion to the cleaning portion in a first direction orthogonal to the first transverse direction;

the substantially "U" shaped portion extends from the bridge portion in the first transverse direction;

the cleaning portion includes a holder portion extending from the substantially "U" shaped portion in a first process direction orthogonal to the first transverse direction and the first direction; and, the cleaning element extends from the holder portion in a second direction opposite the first direction.

2. The printhead of claim 1, wherein:

for an operating mode of the printhead, the lens cleaning assembly is displaceable in a second transverse direction, opposite the first transverse direction, so that the cleaning element is not aligned with the housing in a direction orthogonal to the first transverse direction; and, for a cleaning mode of the printhead, the lens cleaning assembly is displaceable in the first transverse direction to contact an entirety of the at least one lens with the cleaning element.

3. The printhead of claim 2, wherein in the operating mode for the printhead, the at least one lens is displaced beyond the cleaning element in the first direction.

4. The printhead of claim 1, wherein:

the frame includes a rail;

the arm portion includes a slot extending in the first transverse direction, engaged with the rail, opening to a process direction orthogonal to first transverse direction, and partially enclosing the rail; and, engagement of the slot with the rail blocks displacement of the arm portion in three directions orthogonal to the first transverse direction.

5. The printhead of claim 1, further comprising:

a displacement assembly connected to the frame and engaged with the LED assembly, wherein:

for an operating mode of the printhead, the displacement assembly is arranged to displace the LED assembly, with respect to the frame, so that light from the plurality of LEDs illuminates media passing through the printhead in first or second process directions orthogonal to the first transverse direction; and, for a cleaning mode of the printhead, the displacement assembly is arranged to displace the LED assembly, with respect to the frame, so that the lens cleaning assembly is displaceable in the first transverse direction.

6. The printhead of claim 5, wherein:

the displacement assembly includes a shaft with an axis of rotation in the first transverse direction;

the shaft is rotatable in a first rotational direction to displace the LED assembly in a first direction, orthogonal to the first transverse direction, to shift the printhead from the cleaning mode to the operating mode; and, the shaft is rotatable in a second rotational direction, opposite first rotational direction, to displace the LED assembly in a second direction, opposite the first direction, to shift the printhead from the operating mode to the cleaning mode.

7. The printhead of claim 5, wherein the displacement assembly includes a blocking element blocking displacement of the lens cleaning assembly in the first transverse direction while the printhead is in the operating mode.

8. A printhead for a device capable of printing, comprising:

a frame;

a light-emitting diode (LED) assembly including:

a housing engaged with the frame;

a plurality of LEDs on the housing and extending in a transverse direction; and, at least one lens:

parallel to the plurality of LEDs in the transverse direction; and, arranged to focus light from the LEDs;

a lens cleaning assembly engaged with the frame and including:

an arm portion extending across the frame in the transverse direction; and, a cleaner portion including a cleaning element; and, a displacement assembly connected to the frame and engaged with the LED assembly, wherein:

the lens cleaning assembly is displaceable, with respect to the frame, in the transverse direction to slide the cleaning element across the at least one lens;

for an operating mode of the printhead, the displacement assembly is arranged to displace the LED assembly, with respect to the frame, so that light from the plurality of LEDs illuminates media passing through the printbar in first or second process directions orthogonal to the transverse direction; and, for a cleaning mode of the printhead, the displacement assembly is arranged to displace the LED assembly, with respect to the frame, so that the lens cleaning assembly is displaceable in the transverse direction.

9. A printhead for a device capable of printing, comprising:

a frame;

a light-emitting diode (LED) assembly including:

a housing engaged with the frame;

a plurality of LEDs on the housing and extending in a transverse direction; and, at least one lens:

parallel to the plurality of LEDs in the transverse direction; and, arranged to focus light from the LEDs; and, a lens cleaning assembly engaged with the frame and including:

a U-shaped portion including a first slot; and, a first rail:

extending across the frame in the transverse direction; and, partially disposed within the slot; and, a cleaner portion including a cleaning element, wherein:

the U-shaped portion is arranged to slide, with respect to the frame, along the first rail in the transverse direction while the first rail remains stationary, to slide the cleaning element across the at least one lens.

10. The printhead of claim 9, wherein:

the lens cleaning assembly includes:

an arm portion, separate from the U-shaped portion, and including a second slot; and, a second rail extending along the frame in the transverse direction and partially disposed within the second slot; and, the arm portion is arranged to slide along the second rail in the transverse direction when the U-shaped portion slides along the first rail in the transverse direction.

* * * * *